US005533500A

United States Patent [19]

Her-Mou

[11] Patent Number: 5,533,500

[45] Date of Patent: Jul. 9, 1996

[54] HELMET WITH AN AIR FILTERING DEVICE

[76] Inventor: Lin Her-Mou, P.O. Box 82-144, Taipei, Taiwan

[21] Appl. No.: 845,970

[22] Filed: Mar. 4, 1992

[51] Int. Cl.[6] ..... A62B 7/10

[52] U.S. Cl. ..... 128/201.25; 128/201.24; 128/205.12; 2/410

[58] Field of Search ..... 128/200.24, 201.22, 128/201.24, 201.25, 204.18, 205.12, 205.24, 205.25, 205.27, 205.29, 206.12, 206.21; 2/2, 410

[56] References Cited

U.S. PATENT DOCUMENTS

| | | | |
|---|---|---|---|
| 3,822,698 | 7/1974 | Guy | 128/201.24 |
| 4,186,736 | 2/1980 | Angioletti et al. | 128/201.19 |
| 4,227,520 | 10/1980 | Lord | 128/201.24 |
| 4,502,480 | 3/1985 | Yamamoto | 128/201.15 |
| 4,730,612 | 3/1988 | Dampney | 128/201.24 |
| 5,022,900 | 6/1991 | Bar-Yona et al. | 55/316 |
| 5,042,474 | 8/1991 | Williamson | 128/206.12 |
| 5,054,480 | 10/1991 | Bare et al. | 128/201.25 |
| 5,125,402 | 6/1992 | Greenough | 128/201.25 |

*Primary Examiner*—Edgar S. Burr
*Assistant Examiner*—Eric P. Raciti
*Attorney, Agent, or Firm*—Alfred Lei

[57] ABSTRACT

This invention relates to a helmet with an air filtering device and in particular to one which utilizes a meter to drive a fan so as to suck in air and transmit the air through a filtering device which divides the air into two streams respectfully supplied to the head and nose of an user on one hand and exhausts the exhaled air out of the helmet through a plurality of check valve, thereby enabling the user to inhale cleaned air.

1 Claim, 12 Drawing Sheets

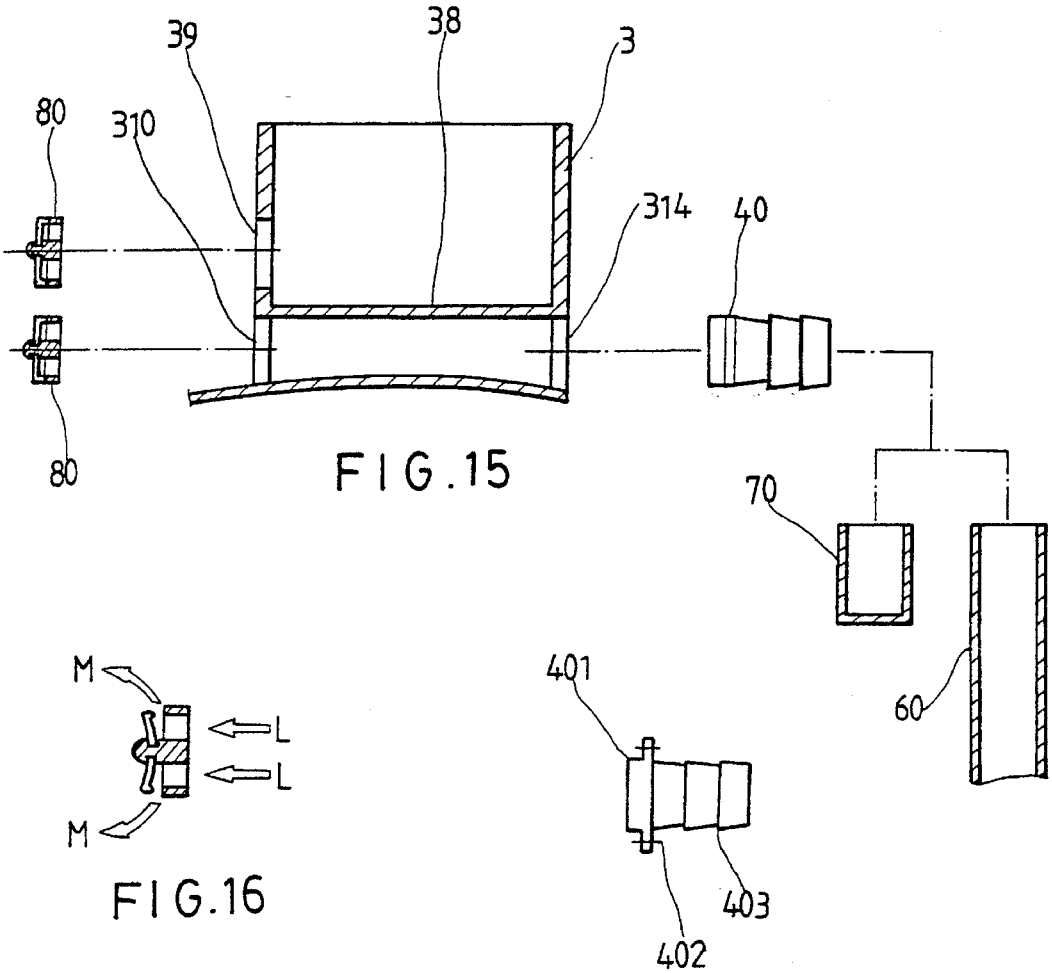
FIG.15
FIG.16
FIG.18C
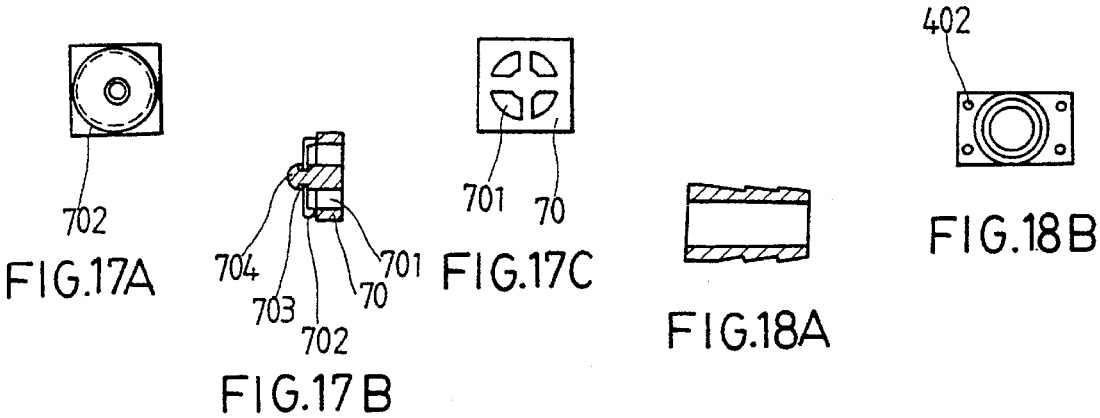
FIG.17A
FIG.17B
FIG.17C
FIG.18A
FIG.18B

HELMET WITH AN AIR FILTERING DEVICE

BACKGROUND OF THE INVENTION

It is found that the conventional mask simply utilizes a visor to separate the face of an user from the outside and enables air to flow in the nose of the user from the lower side of the visor. However, much mask have no filtering effect and cannot keep the user form being hurted by the polluted air. As to the cloth mask, it will obstruct the user from inhaling and exhaling normally thus making the user have a slight oxygenless sign.

Therefore, it is an object of the present invention to provide a helmet which may obviate and mitigate the above-mentioned drawbacks.

SUMMARY OF THE INVENTION

This invention relates an improved helmet with an air filtering device.

It is the primary object of the present invention to provide a helmet with an air filtering device which may effectively clean the air from outside.

It is another object of the present invention to provide a helmet which may enable the user to inhale and exhale normally.

It is still another object of the present invention to provide a helmet with an air filtering device which is simple in construction.

It is still another object of the present invention to provide a helmet with an air filtering device which is economic to produce.

It is a further object of the present invention to provide a helmet with an filtering device which fit for mass production.

Other objects and merits and a fuller understanding of the present invention will be obtained by those having ordinary skill in the art when the following detailed description of the preferred embodiment is read in conjunction with the accompanying drawings.

BRIEF DESCRIPTION OF THE DRAWINGS

FIG. 15 is a fragmentary sectional view taken along line K—K of FIG. 14;

FIGS. 16–17 shows the structure of the check valve of the filtering device;

FIG. 18 shows the structure of the additional connector of the filtering device;

DETAILED DESCRIPTION OF THE PREFERRED EMBODIMENT

Figure 1:
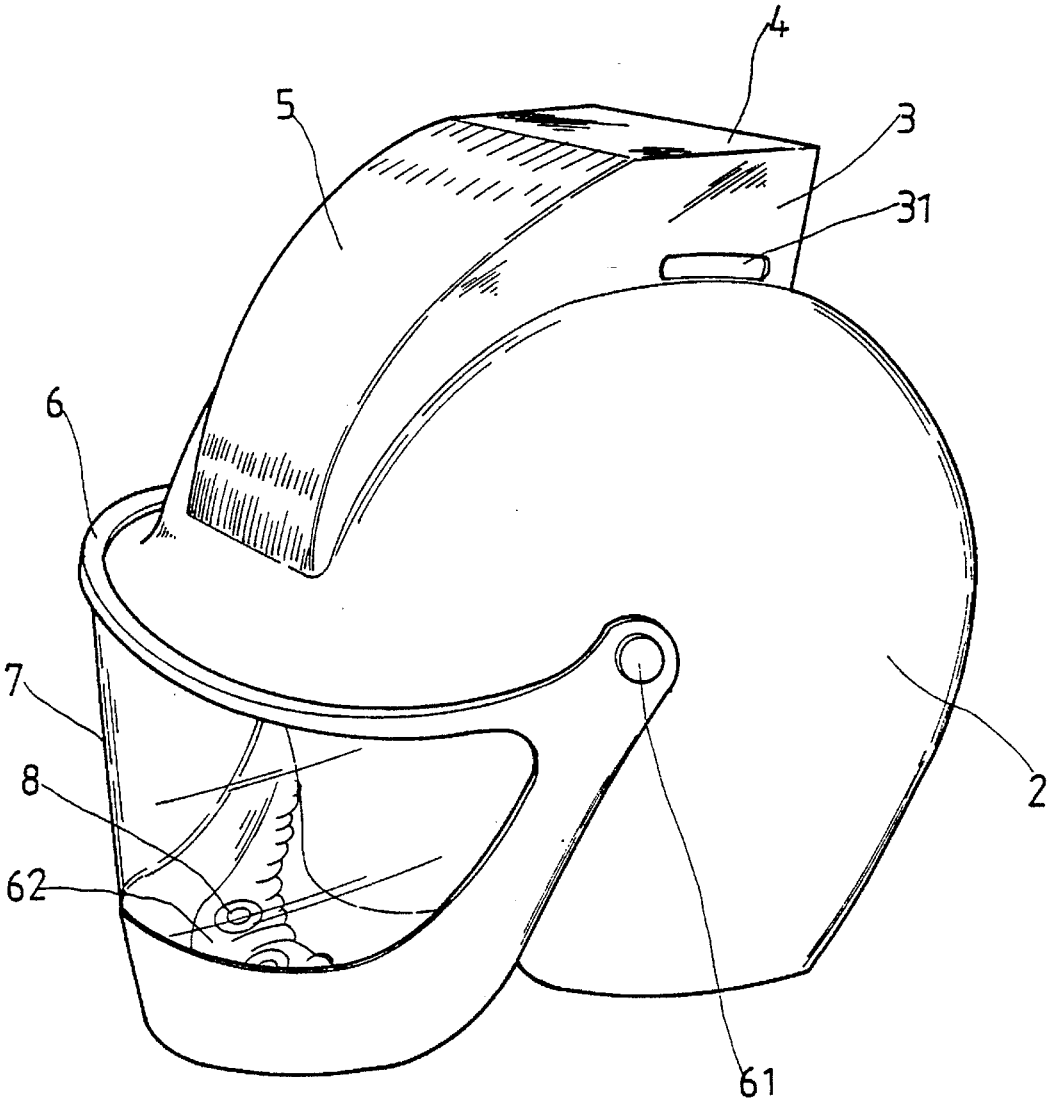
FIG. 1 is a perspective view of a helmet with filtering device according to the present invention.

With reference to the drawings and in particular to FIG. 1 thereof, the helmet with air filtering device according to the present invention mainly comprises a body 2, a filtering means 3, and a face mask 6.

Figure 4:
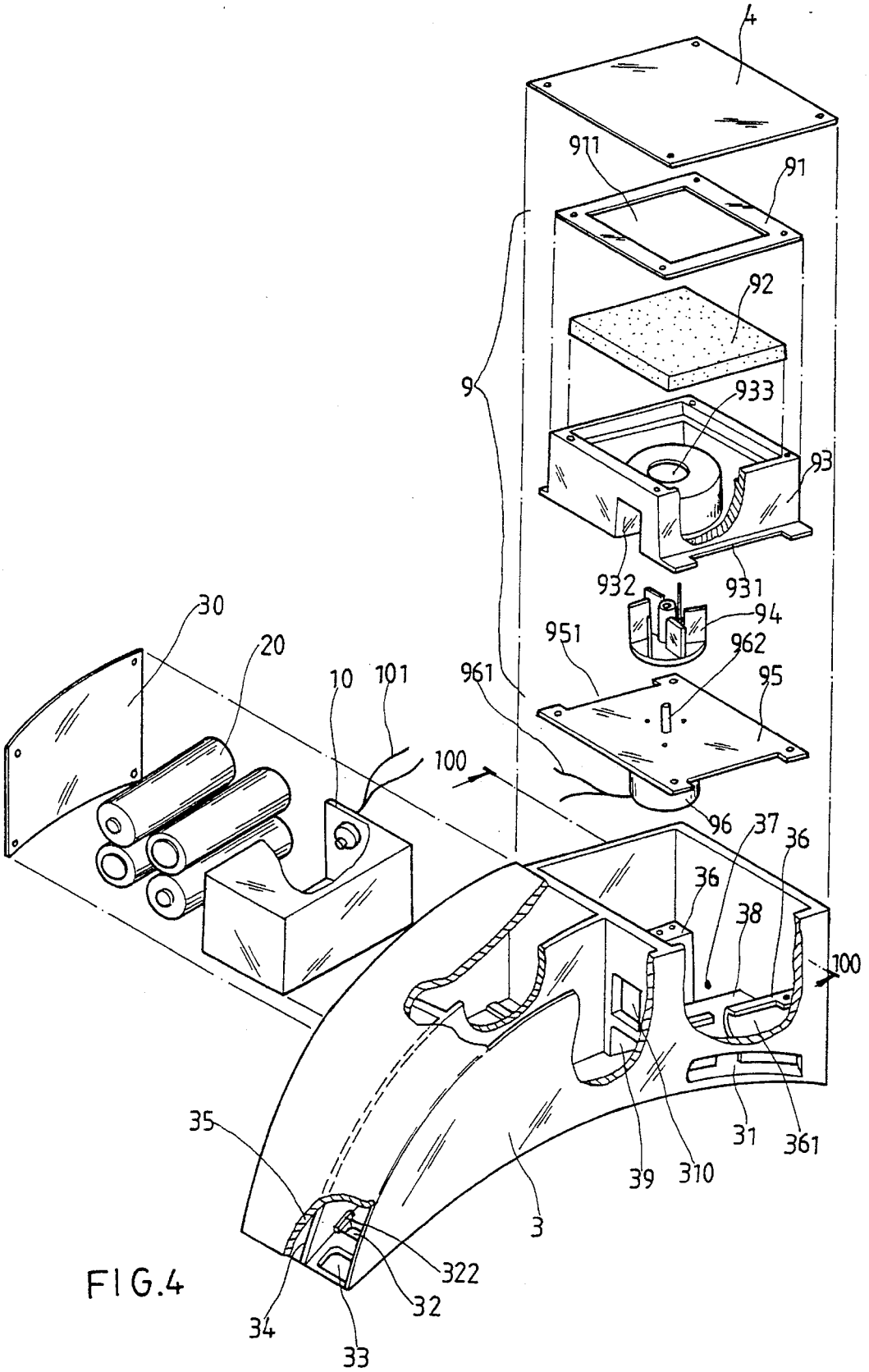
FIG. 4 is an exploded view of the filtering device.
Figure 6:
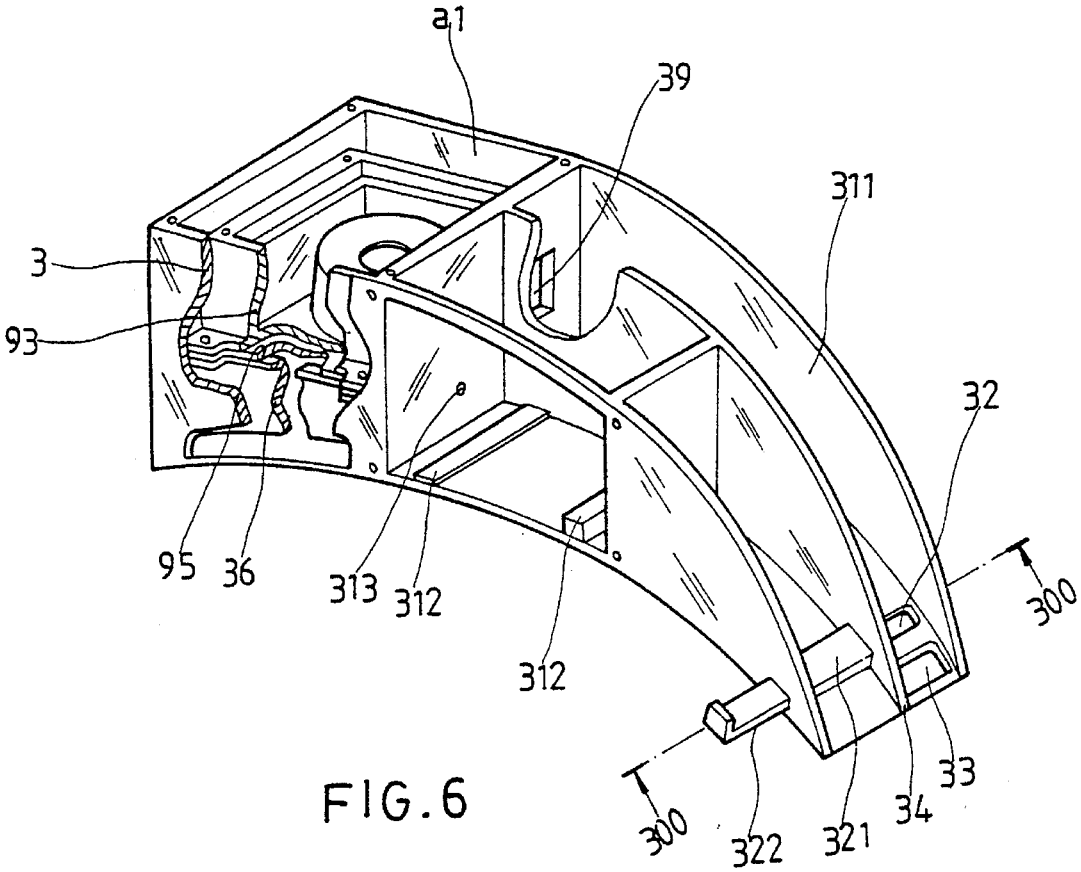
FIG. 6 shows the position of the air inlet.
Figure 7:
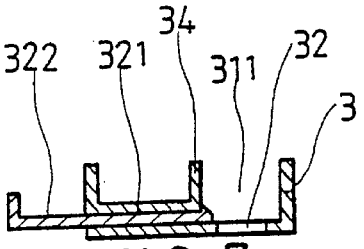
FIG. 7 is a fragmentary sectional view taken along line R—R of FIG. 6.
Figure 8:
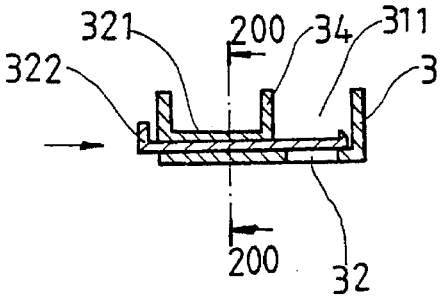
FIG. 8 shows the closed state of the air inlet.
Figure 9:
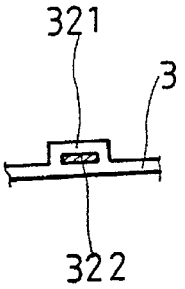
FIG. 9 is a fragmentary sectional view taken along line.
Figure 10:
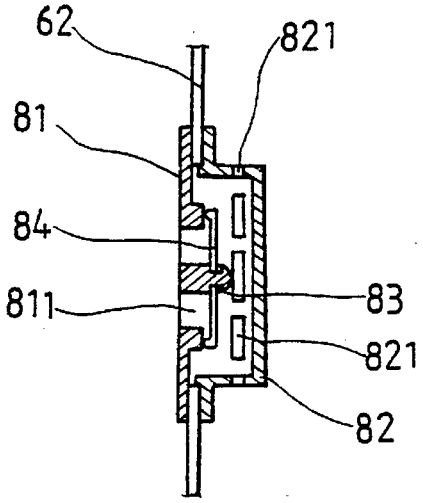
FIGS. 10–13 show the structure of the check valve.
Figure 11:
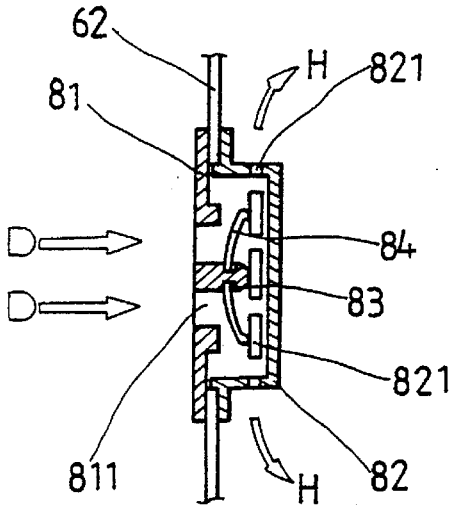
Figure 12A:
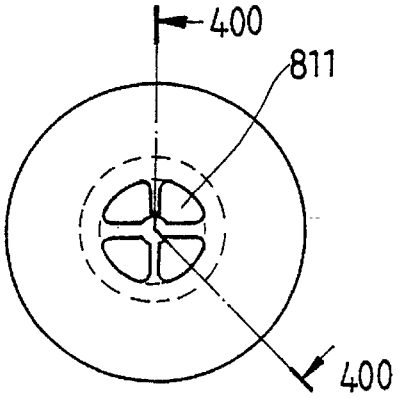
Figure 12B:
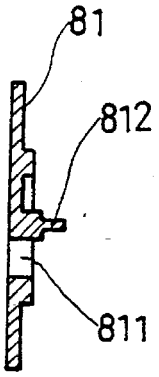
Figure 13A:
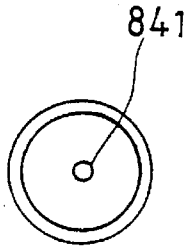
Figure 13B:
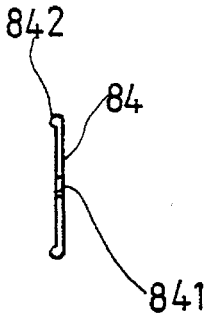
Figure 14:
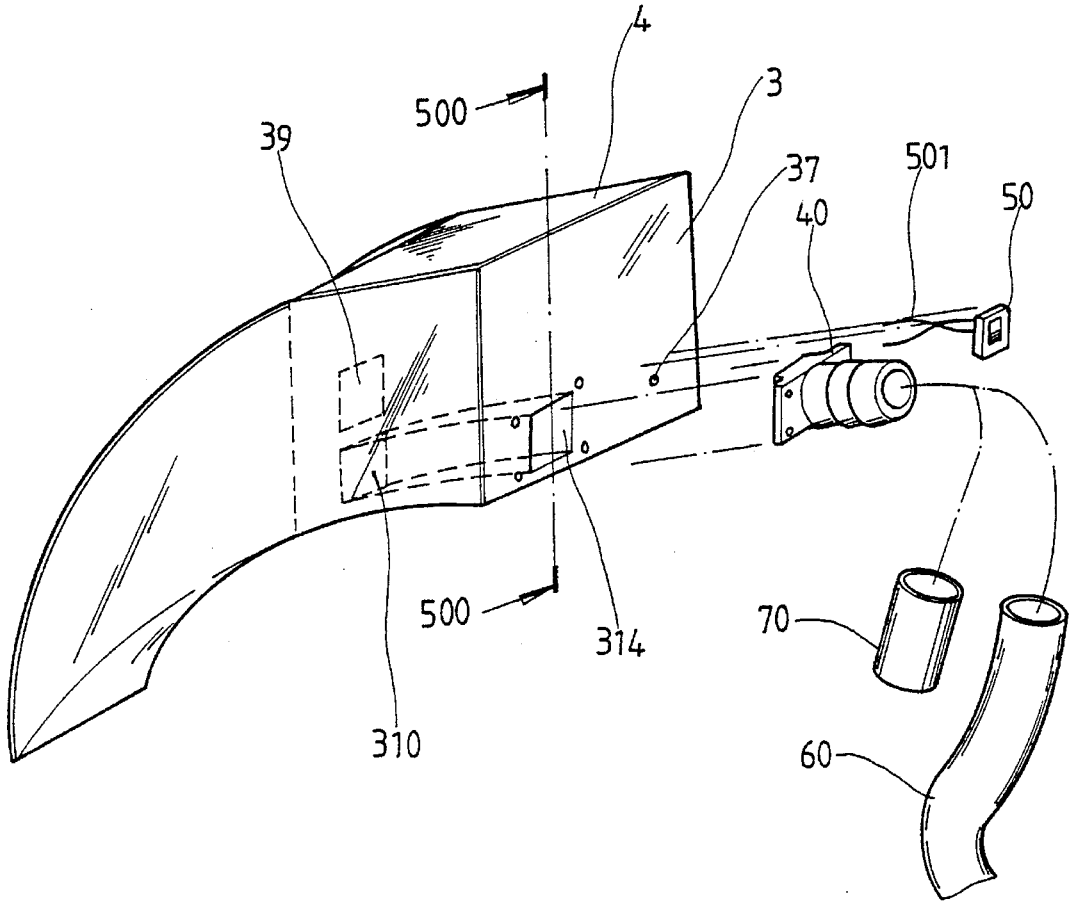
FIG. 14 show another preferred embodiment of the present invention.
Figure 19:
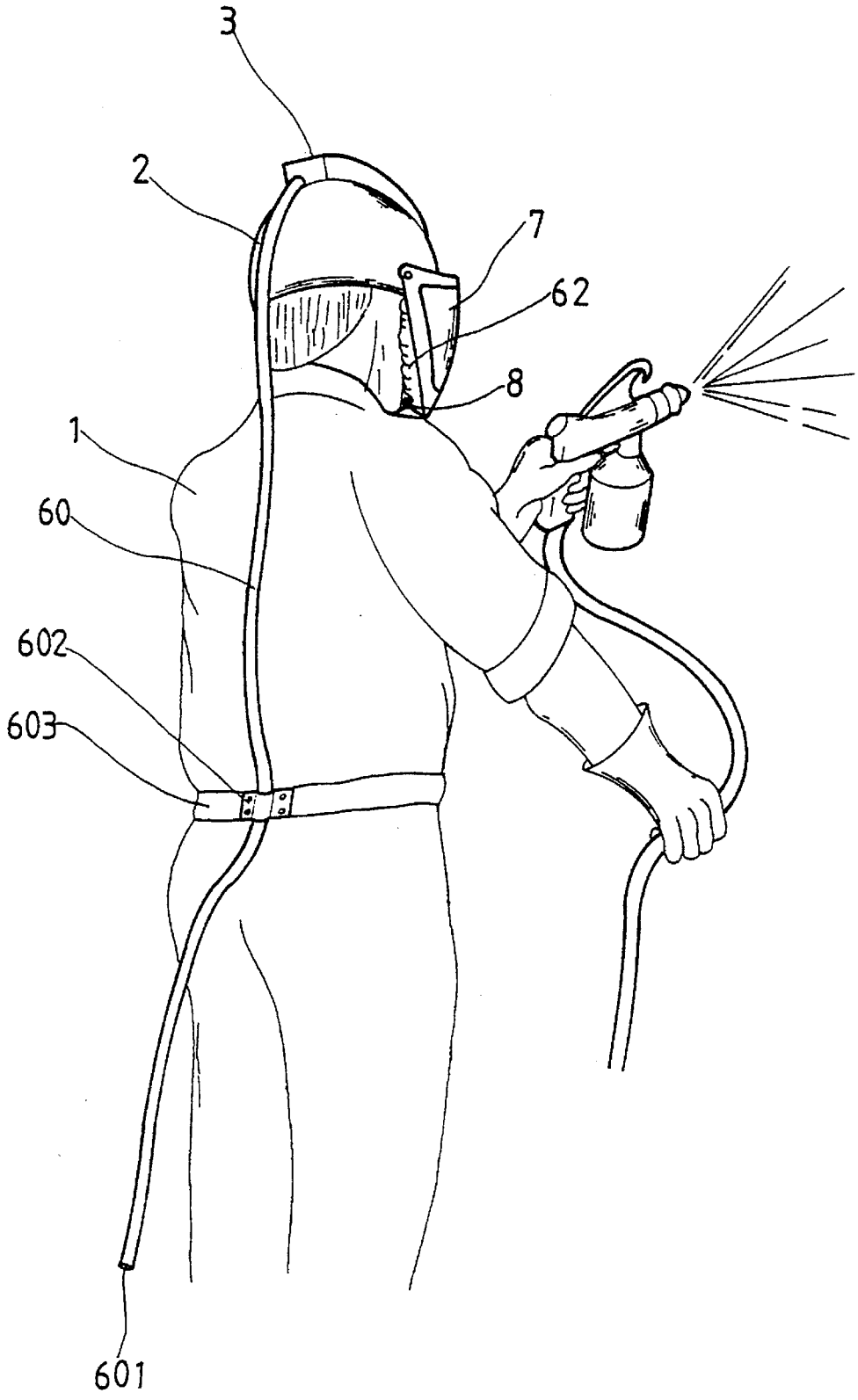
FIG. 19 is a working view of the present invention.
Figure 20:
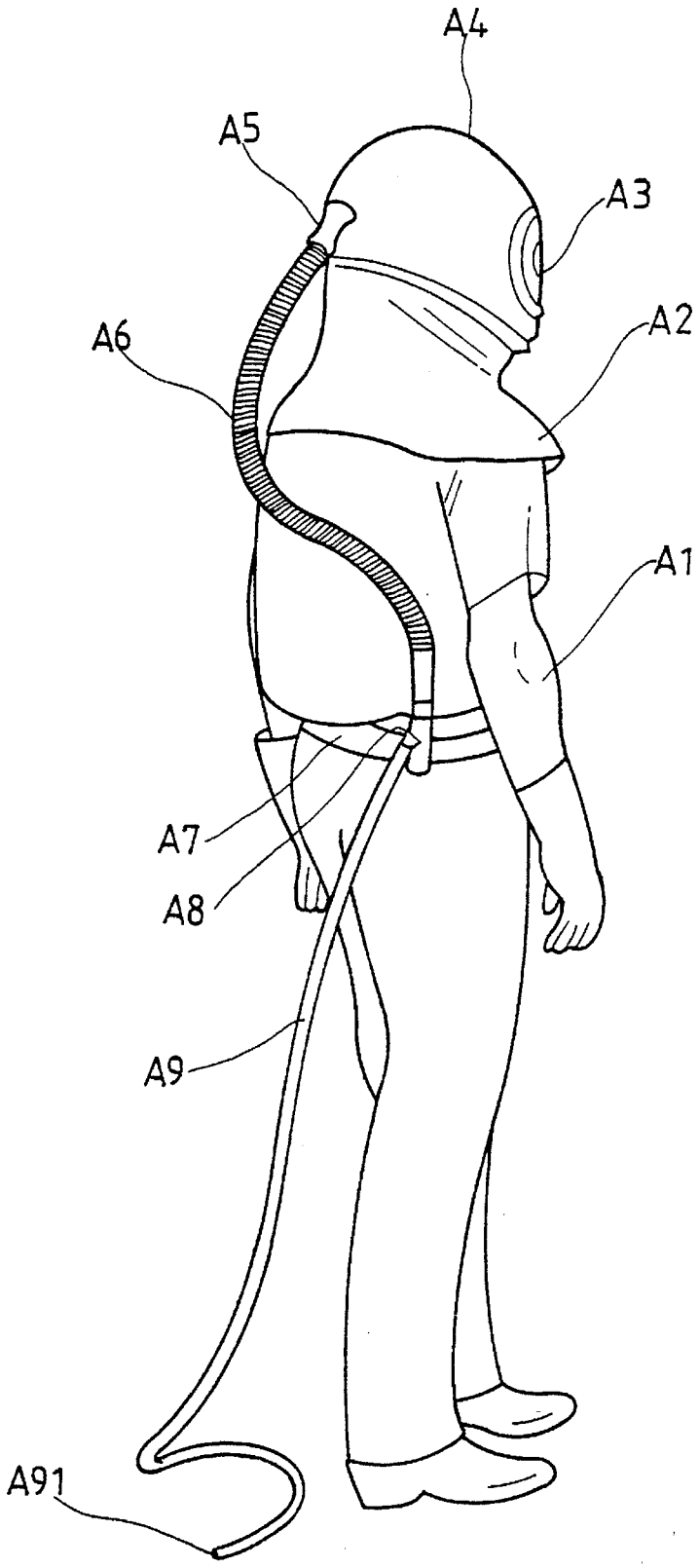
FIG. 20 is a working view of a prior art helmet.
Figure 21:
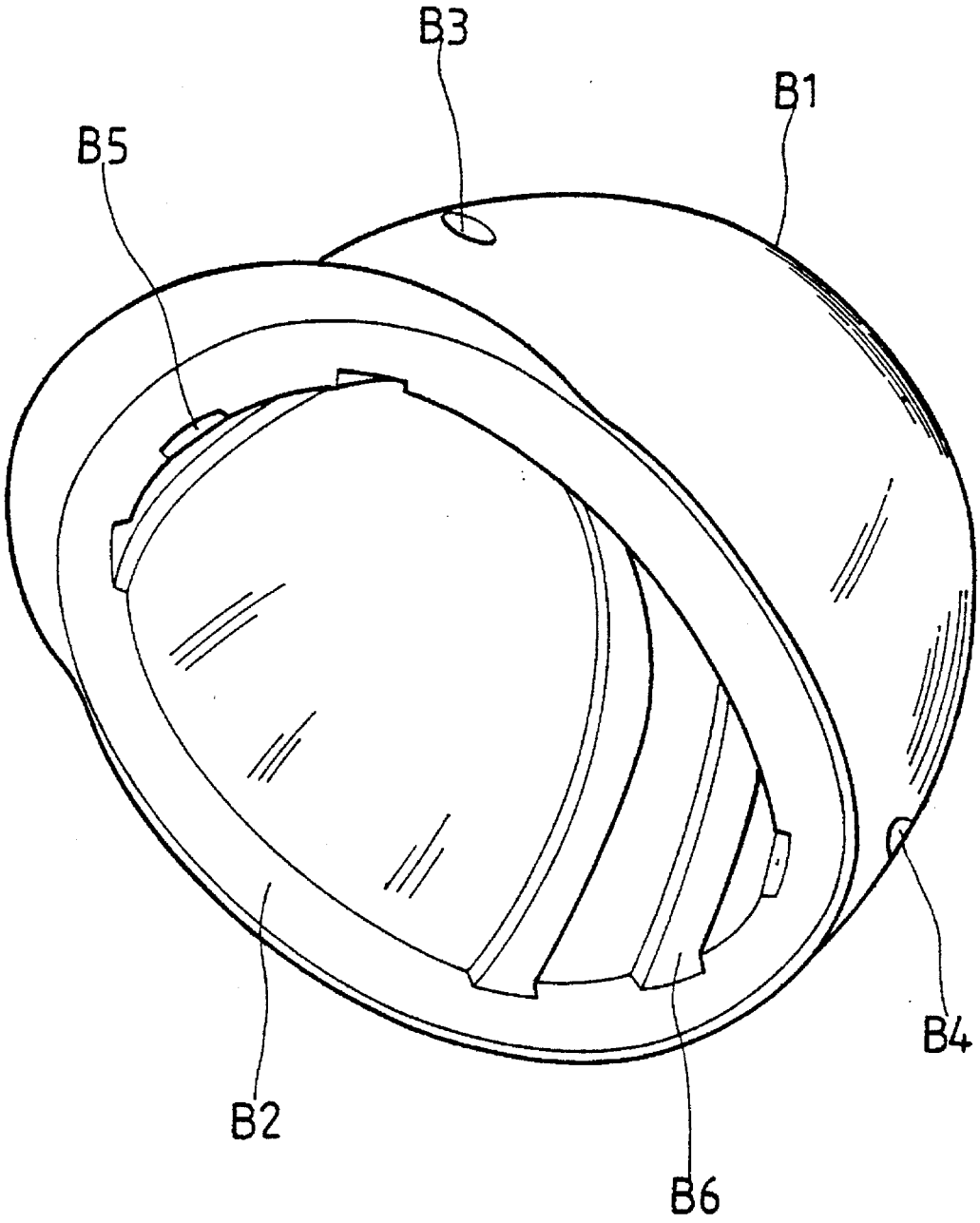
FIG. 21 is a perspective view of a prior art safety cap.

The filtering means 3 is mounted on the body 2 which is provided with a curved surface 5 in the front. The face mask 6 is engaged with the body 2 by two threads 61. A visor 7 is mounted on the face mask 6. A soft pad 62 is arranged on the inner side of the face mask 6 for closely contacting the face of the wearer. A plurality of check valves 8 are mounted on the soft pad 62. The filtering means 3 (see FIGS. 4 and 6) is chiefly composed of a battery case 10, a filter 9, an air duct 38, and a curved ventilation passage 311. The filter 9 is provided with a filtering layer 92, a chamber with an inlet 933 and an outlet 932, a fan 94, and a seat 95. On the seat 95 there is mounted a DC motor 96. The fan 94 is sleeved on the axle 92 of the motor 96. The seat 95 and the chamber 93 are locked on a bracket 36. The filtering layer 92 is encased in a package thereby preventing the filtering layer 92 from being damaged by the fan 94. The filtering layer 92 is disposed on the chamber 93 and kept in place by a rectangular frame 91 fixedly mounted on the chamber 93 by four screws. The seat 10 is used to receive batteries 20, which is mounted on the packing strip 312 and provided with a cover 30. The seat 10 is connected with an electrical wire 101 which passes through a hole 313 to connect in series with an electrical wire 961 of the motor 96. Then the electrical wire 101 extends through a hole 37 to connect in series with a switch 50. Thus, the present invention can be used anywhere.

Figure 5:
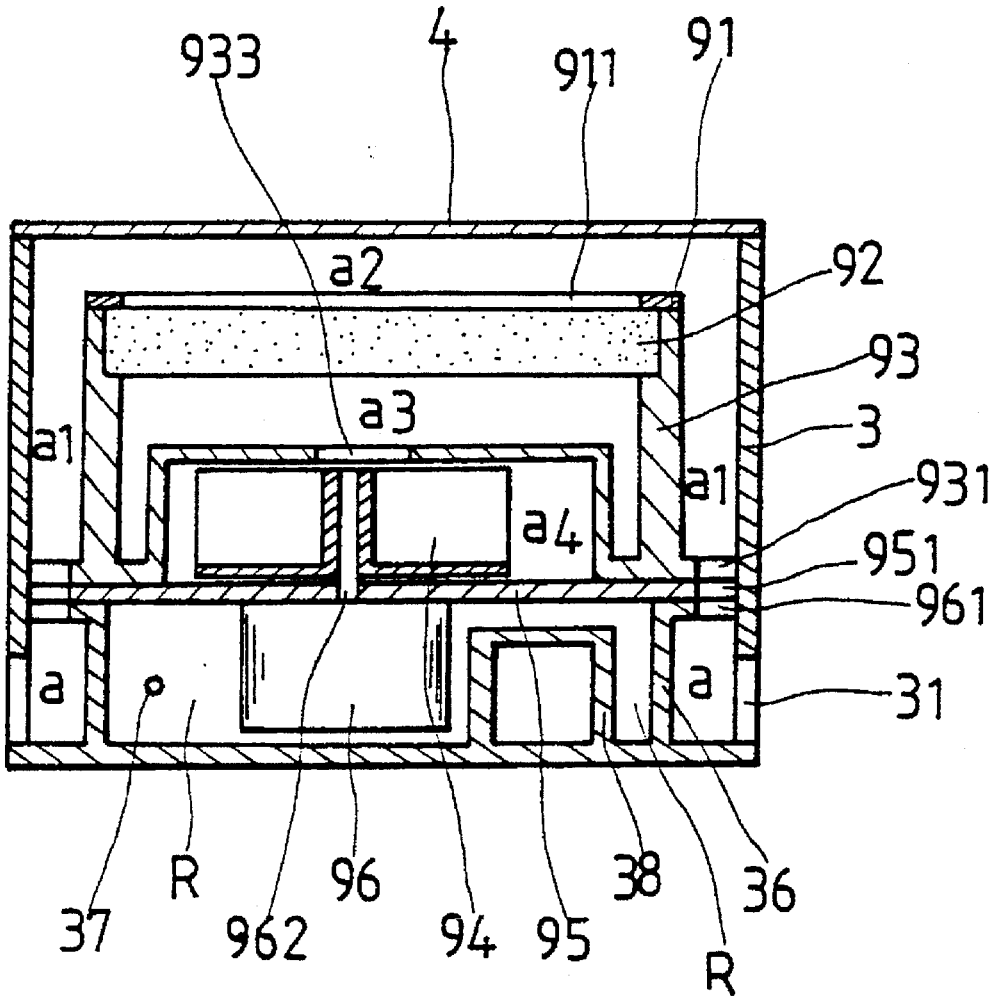
FIG. 5 is a sectional view taken along line B—B of FIG. 4.

Referring to FIG. 5, when the motor 96 is turned on, the fan 94 will be rotated to suck air through an elongated slot 31 of the filtering means 3 and the passages 361, 951 and 931 to a1 and a2. As air passes through such curved passages, the rain water and large particles may be revented from entering therein. Then, the air is filtered by the filtering layer 92 and passes through the orifices a3 and a4 to outlets 932 and 39 (see FIGS. 4 and 6). Thereafter, the air flows through the curved passage 311 and divided into two streams, one passing into the inlet 32 while the other into the inlet 33. The air flowing into the inlet 32 will pass into the duct 242 (see FIG. 3), as shown in the arrow B1. Then, the air will flow into the passage 221 of the chamber 22. Thereafter, the air will flow into the helmet through the perforations 222 of the chamber 22. As shown in the arrow t of FIG. 3, the air temperature will be lowered due to the convection of the air. In case of cold weather, simply slide the panel 322 along the rack 321 to close the inlet 32.

Figure 2:
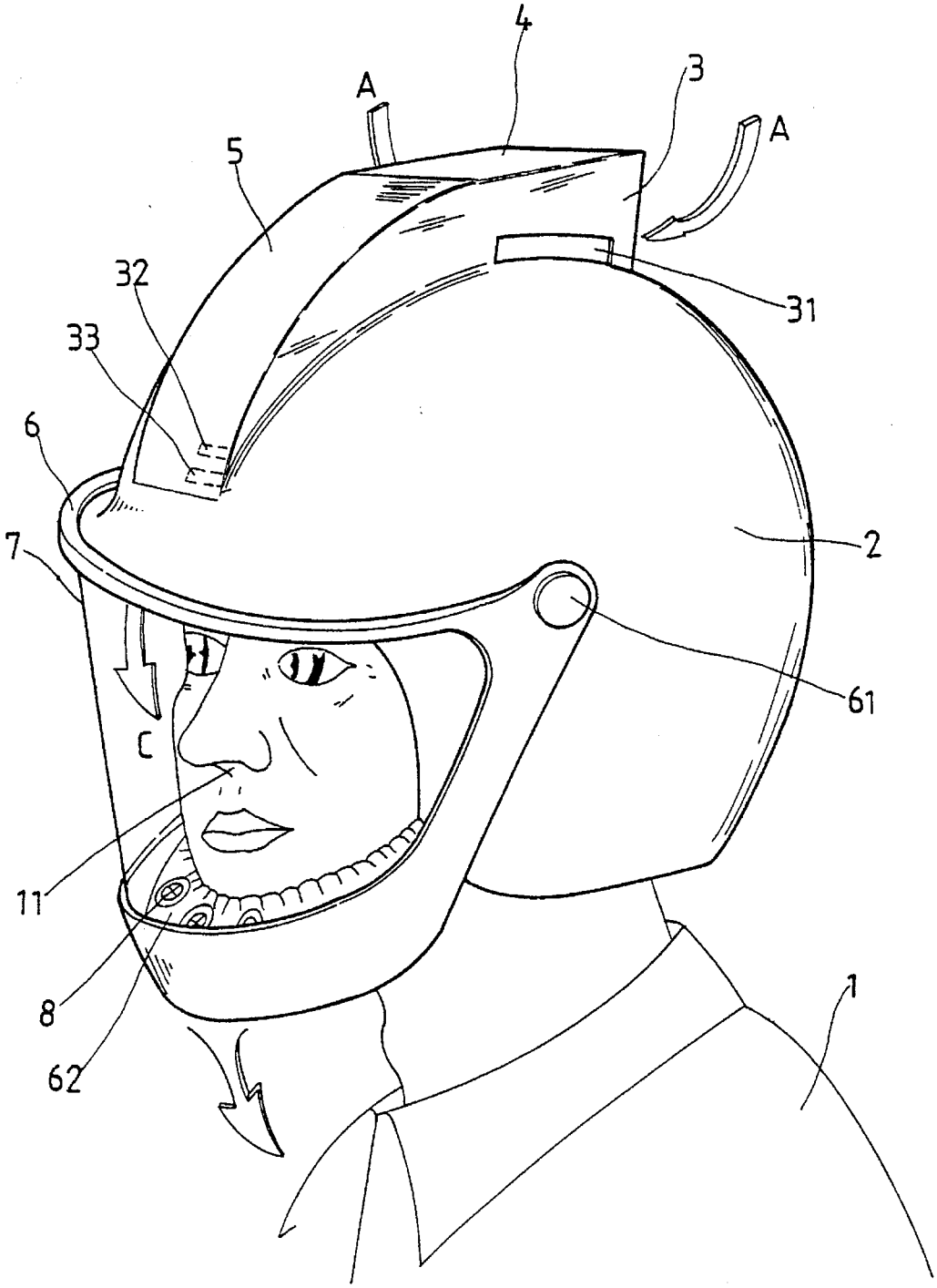
FIG. 2 is a working view of the present invention.
Figure 3C:
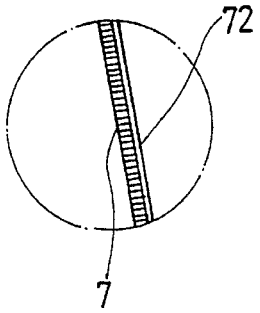
FIG. 3C is an enlarged fragmentary view of FIG. 3B.
Figure 3D:
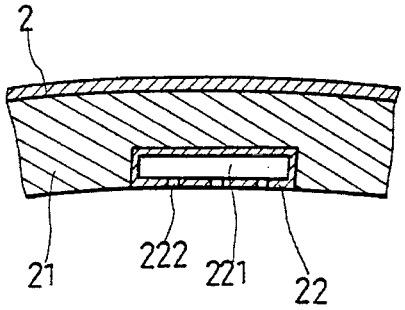
FIG. 3D is an enlarged sectional view taken along line Q—Q of FIG. 3A.
Figure 3B:
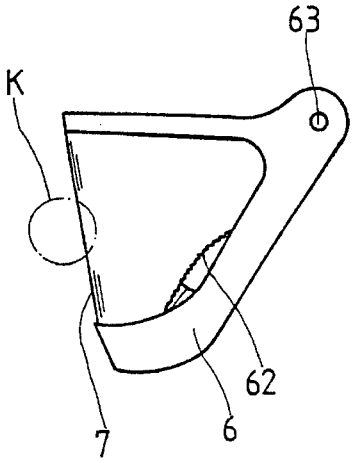
FIG. 3B is a side view of the face mask.
Figure 3A:
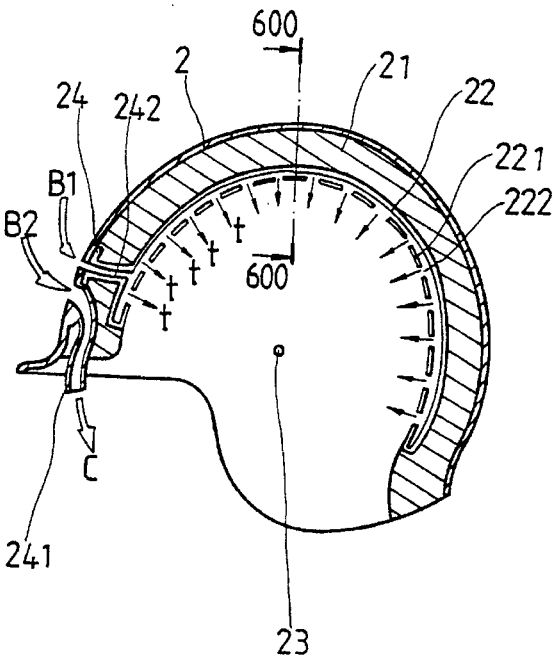
FIG. 3A is a sectional view of the body.

The other cleaned air stream B2 (see FIG. 3) passes through the inlet 33 into an angular outlet 241 of a lining 21 fitted in the body 2 (see FIG. 3A) thereby forming a central stream C concentrated to the nose 11 (see FIG. 2). In the meantime, the exhaled air is exhausted out of the helmet through the check valves 8 on the soft pad 62 in the direction as shown in the arrow J of FIG. 2. The check valve 8 (see FIGS. 10–13) has an upper plate 81 with a protuberance 81 adapted to engage the hole 841 of a highly resilient rubber member 84. A metallic plate 83 is then put on to the rubber member 84. A lower plate 82 is mounted on the soft pad 62 and fixedly engaged with the upper plate 81. The exhaled air will be exhausted through the holes 811 and 821 is the direction as shown is the arrow H thus preventing air to enter in reverse direction. Further, the inner side of the visor 7 may be provided with a mist-proof plate 72 (see FIG. 3).

FIGS. 4, 5, 14, 15, 16, 17 and 18 show another function of the present invention. As illustrated, the filtering device 3 has a duct 38 and a hole 314 engaged with an end 401 of a connector 40 (see FIGS. 15 and 18. A flexible pipe 60 is forced to fit on the toothed grooves 403 at one end and connected with a compressor at the ether. When not in use, simply disconnect the flexible pipe 60 from the connector 40 and then press a plug 70 therein. The hole 310 at the other end of the filtering device 3 is provided with a check valve 80 so that the air will not flow back into the duct 38 through the check valve 80. The filtered air passing through the orifice 39 and the exhaust valve 70 will not flow back into the duct 38 through the check valve 80. Finally, the air enters the curved passage 31 and is divided into two streams flowing to the head and nose respectively.

Although the present invention has been described with a certain degree of particularity, it is understood that the present disclosure is made by way of example only and that numerous changes in the detail of construction and the combination and arrangement of parts may be resorted to without departing to without departing from the spirit and scope of the invention as hereinafter claimed.

I claim:

1. A helmet with an air filtering device comprising:

a body with a filtering device mounted on said body and a face mask arranged on a front side of said body;

a lining fitted in said body and having an angular outlet;

said filtering device being provided with two elongated slots and a connector for connecting with a flexible pipe, a filtering means, a battery case, a duct and a curved passage, said filtering means being composed of a fixing plate, a filtering layer, a fan with an inlet and an outlet, a seat and a motor installed on said seat;

said face mask threadedly mounted on said body and having a mist-proof plate and a soft pad on a lower part so as to be in contact with the face of an user, said soft pad having a plurality of check valves each provided with an upper plate, a highly resilient rubber member engaged with said upper plate, and a lower plate closely connected with said upper plate.

* * * * *